US005139196A

United States Patent [19]

Fry et al.

[11] Patent Number: 5,139,196

[45] Date of Patent: Aug. 18, 1992

[54] PAPERBOARD CONTAINER

[75] Inventors: Stanley L. Fry, Covina, Calif.; Lelia H. Francisco, Riverdale, Ga.

[73] Assignee: International Paper Company, Purchase, N.Y.

[21] Appl. No.: 795,356

[22] Filed: Nov. 20, 1991

Related U.S. Application Data

[63] Continuation-in-part of Ser. No. 724,661, Jul. 2, 1991, abandoned.

[51] Int. Cl.[5] ..... B65D 5/08

[52] U.S. Cl. ..... 229/157; 229/109; 229/185

[58] Field of Search ..... 229/109, 110, 138, 156, 229/157, 185, 40, 144

[56] References Cited

U.S. PATENT DOCUMENTS

| | | | |
|---|---|---|---|
| 3,907,194 | 9/1975 | Davenport | 229/109 |
| 3,945,558 | 3/1976 | Elder | 229/109 |
| 4,119,266 | 10/1978 | Dempster | 229/109 |
| 4,225,078 | 9/1980 | Croley | 229/109 |
| 4,313,556 | 2/1982 | Boyle et al. | 229/110 |
| 4,341,341 | 7/1982 | Roccaforte | 229/138 |
| 4,343,429 | 8/1982 | Cherry | 229/109 |
| 4,361,267 | 11/1982 | Wozniacki | 229/109 |
| 4,382,537 | 5/1983 | Muise | 229/109 |
| 4,386,729 | 6/1983 | Schmidt | 229/109 |
| 4,392,607 | 7/1983 | Perkins, Jr. | 229/109 |
| 4,441,649 | 4/1984 | Nederveld | 229/109 |
| 4,502,624 | 3/1985 | Burrell | 229/109 |
| 4,511,080 | 4/1985 | Madsen | 229/109 |
| 4,614,298 | 9/1986 | Cherry | 229/109 |
| 4,650,112 | 3/1987 | Booth | 229/157 |
| 4,702,408 | 10/1987 | Powlenko | 229/101 |
| 4,821,949 | 4/1989 | Booth | 229/157 |
| 4,850,527 | 7/1989 | Church et al. | 229/110 |

*Primary Examiner*—Gary E. Elkins
*Attorney, Agent, or Firm*—Walt Thomas Zielinski

[57] ABSTRACT

A container for produce is formed from a flat unitary blank of corrugated paperboard. The container sides include length and width panels and four corner panels. The container bottom is preferably formed by four interlocking panels, each of which is foldably attached to the bottom edge of a respective length or width panel. To facilitate erection of the container from its shipping, flattened configuration, a generally triangular gusset is provided at the lower end of each corner panels, foldably secured to the latter along one of its three sides. A second side of each gusset panel is foldably secured to respective minor bottom panels secured to the width side panels. The third side of each gusset panel is a free side or edge, not being connected to any panel. Each gusset panel is folded over on itself and located between adjacent bottom panels. Upon folding of the minor panels towards each other, the gussets cause the container to assume an octagonal configuration.

19 Claims, 3 Drawing Sheets

PAPERBOARD CONTAINER

BACKGROUND OF THE INVENTION

This is a Continuation-In-Part of our co-pending application Ser. No. 07/724,661; filed Jul. 2, 1991; entitled PAPERBOARD CONTAINER now abandoned.

This invention relates to a paperboard container and especially adapted to hold vegetables or other produce. The container is formed form a flat, unitary blank of paperboard, suitably cut and scored to form an eight-sided container when folded and glued. The bottom panels of the container are provided with conventional interlocking tongue and slot connections to facilitate final erection from a folded tube type storage configuration. The prior art is aware of somewhat similar containers having interlocking bottom closure flaps, such as shown in Austrian Pat. No. 218,420 of 1961 issued to Stoklasek and U.S. Patent Nos. 4,279,377 issued to Peeples and 4,884,741 issued to Nederveld. While these and other known constructions appear satisfactory, there is a need for an easily erectable produce carton or container which has greater reinforcement at its corners.

SUMMARY OF THE INVENTION

According to the practice of this invention, a container fashioned from a unitary blank of corrugated paperboard or the like is provided with four additional sides at its corners, so as to form an octagonal configuration. The lower ends of each of these corner panels are each provided with a gusset or bellows, generally triangular in form, each gusset being hingedly or foldably secured to a respective corner forming side panel along one of its three edges. A second edge of each of these gusset panels is foldably secured to a respective bottom panel, the bottom panel typically being foldably secured to one of the two minor width panels of the container. The third edge of these generally triangular gussets is termed a free edge since it is not secured or connected to any other panel. Each gusset panel, in turn, is provided with a fold line extending from a point along the longest side of the triangle to that corner of the triangle which is opposite the longest side. The four additional sides reduce stress concentration at the corners. The function of the gussets or bellows is to assist in setting up the container from its flattened condition. The container is glued at the ends to form a flattened tube, as is conventional in the container art. For setting up the containers, the tube is opened and the major closure flaps folded towards each other. Their free ends overlap somewhat. Then, the minor bottom flaps are folded towards each other. By virtue of the gusset or bellows flaps, this motion causes the long sides of the container to spread apart somewhat, thus causing the corner sides to assume their desired 45 degree relation with adjacent long and short sides of the container.

In a fourth modified form of the invention, the gusset panels are again each foldably secured to a respective corner forming side panel at one gusset edge, and are foldably secured along a second gusset edge to a respective major or longitudinal bottom panel. This is in distinction to the first embodiment wherein the corresponding second gusset edges are foldably secured or joined to respective minor or width bottom panels. Further, the free edge (not connected to any panel) of each gusset is convexly curved, instead of straight. Still further, the same fold line extends across each gusset in both embodiments.

DETAILED DESCRIPTION OF THE INVENTION

Figure 1:
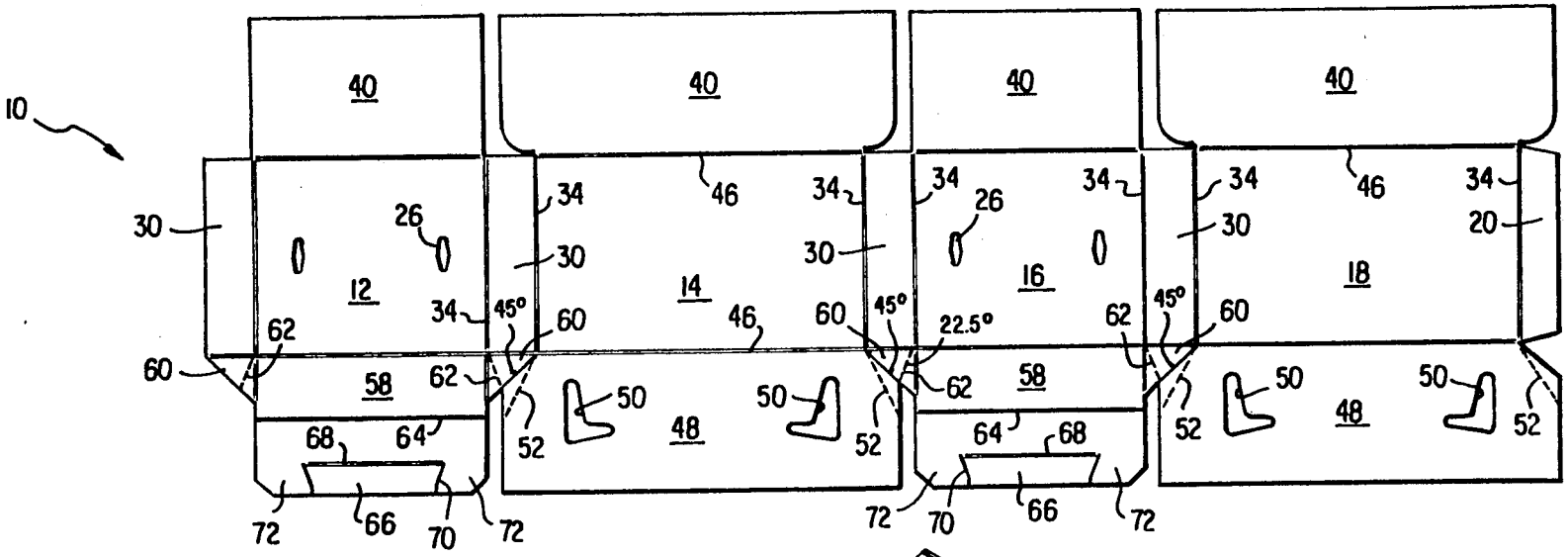
FIG. 1 is plan view showing a flat corrugated paperboard blank from which the container of the invention is formed.

Referring now to FIG. 1 of the drawings, the numeral 10 denotes generally a corrugated paperboard blank from which the container of the invention is formed. The blank includes a plurality of side forming panels 12, 14, 16, and 18, with panel 18 having a manufacturer's flap 20 foldably secured to its right edge. The leftmost portion of the blank is provided with a corner forming panel 30. Panels 12 and 16 are termed width panels and are preferably provided with a plurality of ventilating openings 26. Panels 14 and 18 are termed length panels. Corner forming panels 30, also side forming panels, alternate along the blank and separate the length and the width panels from each other. Score lines 34, running vertically, separate and define the several side forming panels. Thus, each of the corner forming panels 30 are bounded by the right and left by score lines 34, except for left most panel 30. Top forming panels 40 are hingedly or foldably secured to corresponding length and width panels along horizontally running score lines 46, as are lower or bottom forming panels 48 and 58 Bottom forming panels 48 are termed major closure panels, while bottom forming panels 58 are termed minor bottom forming panels.

Major bottom flap forming panels 48 are each provided with a pair of generally L-shaped locking openings 50 whose function will later be described. Further, each edge of each major bottom flap 48 is provided, near its hinge line 46, with a score line 52 to facilitate folding of the major bottom forming panels 48, as will be described. Each line 52 originates at an intersection of some of the score lines 34 and 46.

The lower portion of each corner forming panel 30 is hingedly secured to a gusset forming panel 60 of generally triangular shape. As illustrated at FIG. 1, each gusset panel 60 is in the form of a 45 degree right triangle having a first of its two shorter sides or edges hingedly secured to the lower edge of a respective corner forming panel 30 along line 46. The second of its shorter sides is hingedly secured along a fold line 34 to a respective side edge of a minor bottom forming flap 58. The third or longest side of each triangular gusset panel 60 (the hypotenuse) is termed a free side or free edge and is not connected to any panel. Each panel 60 is provided with a fold line 62 which extends from its third, free edge to the opposite vertex of the triangle. The angle that fold line 62 makes with the second (vertically running) side of the triangle is about 22.5 degrees. The point on the hypotenuse of each gusset 60 at which each fold line 62 commences is at the intersection of the vertically extending edges of major bottom flaps 48 and the hypotenuse of each triangular gusset 60.

Each of the two minor bottom panels 58 is provided with a horizontally extending score or fold line 64 to facilitate locking, as will later be explained. A flap 66 is also provided at the lower or free edge of each minor bottom closing flap 58, panel 66 hingedly secured to its respective bottom panel along a hinge line 68. Cuts extending entirely through the paperboard are denoted as 70 and define the edges of flaps 66.

The width of bottom forming panels 48 and 58 is slightly greater than one half of the width of side forming panels 12, 14, 16, 18, and 30.

After the blank of FIG. 1 has been formed, the blank is folded and manufacturer's flap 20 glued to one surface of leftmost corner forming panel 30 to form a substantially double thickness panel. This results in a flattened tube. These flattened tube are then shipped to a packaging location where a container will be opened, erected or set up, and filled with produce such a lettuce.

Figure 2:
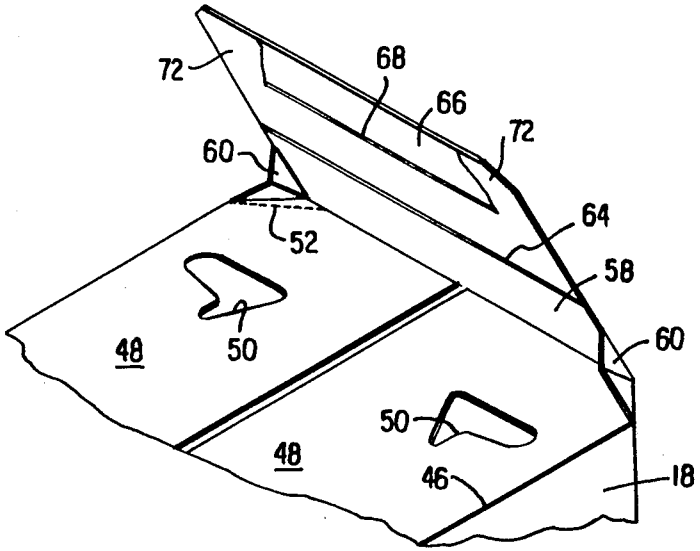
FIG. 2 is a partial perspective view looking at the bottom of the container during and intermediate stage in erecting the container.

FIG. 2 illustrates an intermediate stage in the erection of the container in this invention. The flattened container is opened up and major bottom closure panels 48 are folded towards each other. Score lines 52 assist in permitting the edges of panels 48 to bend and thus pass over gusset panels 60. They will slightly overlap at their free edges. Then, minor bottom panels 58 are folded towards each other. This folding produces a force on each of gusset panels 60, in turn producing a force which tends to spread the longitudinal sides 14 and 18 of the container apart, away from each other. In turn, this causes the corner forming panels 30 to form 45 degree angles with their adjacent long side panels 14, 18 and width panels 12, 16. Thus, after minor bottom flaps 58 have been folded flat, a regular octagonal configuration is automatically established. This construction is in distinction to some octagonal container constructions wherein there is no positive means acting on the container walls to properly position the flat corner panels 45 degrees with respect to the end and side panels.

Again referring to FIG. 2, each minor bottom panel is rotated about line 46 and also folded about its score line 64 so as to insert respective locking tongues 72 into respective locking openings 50. Prior to such insertion, each flap 66 is folded about its respective fold line 68 so as to lie against the inside surface of its respective minor bottom panel. Alternatively, they could remain in the planes of their respective panels 58. Gussets 60 each fold about its score line 62, the folded gussets lying between the major and minor panels.

Figure 3:
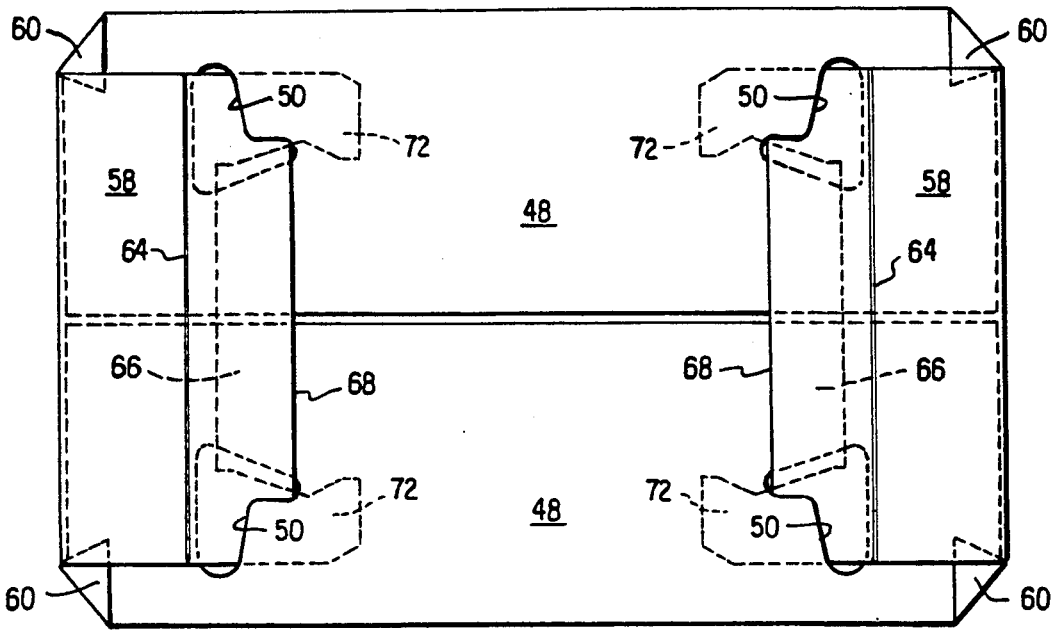
FIG. 3 is a bottom plan view, looking from the outside, of a container formed from the blank of FIG. 1.

The bottom of the fully erected container of this invention is shown at FIG. 3. The reader will understand that there is a gap illustrated between the free edges of major panels 48 in both FIGS. 2 and 3 for purpose of illustration only. In practice, this gap would be practically non-existent.

In practice, containers of this general type which are used for the packaging of produce, such as lettuce, and are often overpacked, causing bulging at the sides of the container and also, even without overpacking, producing a downward force on the bottom of the container tending the swing the major panels 48 outwardly, thereby permitting discharge of the contents when the container is lifted. To prevent this opening of major flaps 48, locking tongues 72 are so engaged with some of the edge portions of lock openings 50, that any tendency for major flaps 48 to swing open is resisted by locking tongues 72. Namely, locking tongues 72 act to prevent the hinging open of major panels 48. This action itself forms no part of the invention and is shown, for example, in Austrian Pat. No. 218,420, earlier mentioned. The reader will accordingly understand that the specific form or shape of lock openings 50 and locking tongues 72 form no part of this invention, any particular form of these elements being suitable so long as the locking tongues 72 prevent, by engaging with peripheral portions of lock openings 50, the swinging open of major panels 48 under load.

Figure 4:
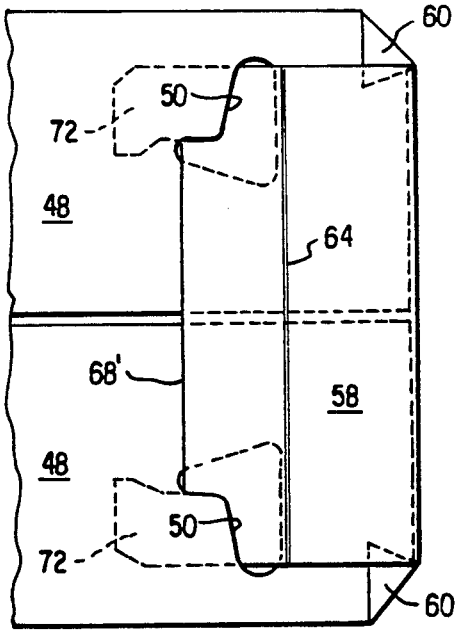
FIG. 4 is a partial plan view similar to FIG. 1 showing a second embodiment.
Figure 5:
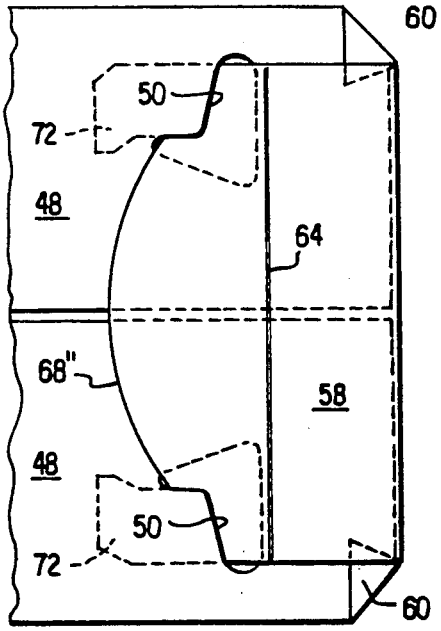
FIG. 5 is a partial plan view similar to FIG. 1 showing a third embodiment.

Turning now to FIG. 4, a second embodiment of the invention is illustrated which differs only from that shown at FIGS. 1-3 in the omission of flap 66. Hinge line 68 is replaced by free edge 68'. Similarly, FIG. 5 shows a third embodiment wherein score line 68 of the embodiment FIGS. 1-3 is replaced by an arcuate free edge 68'.

Figure 6:
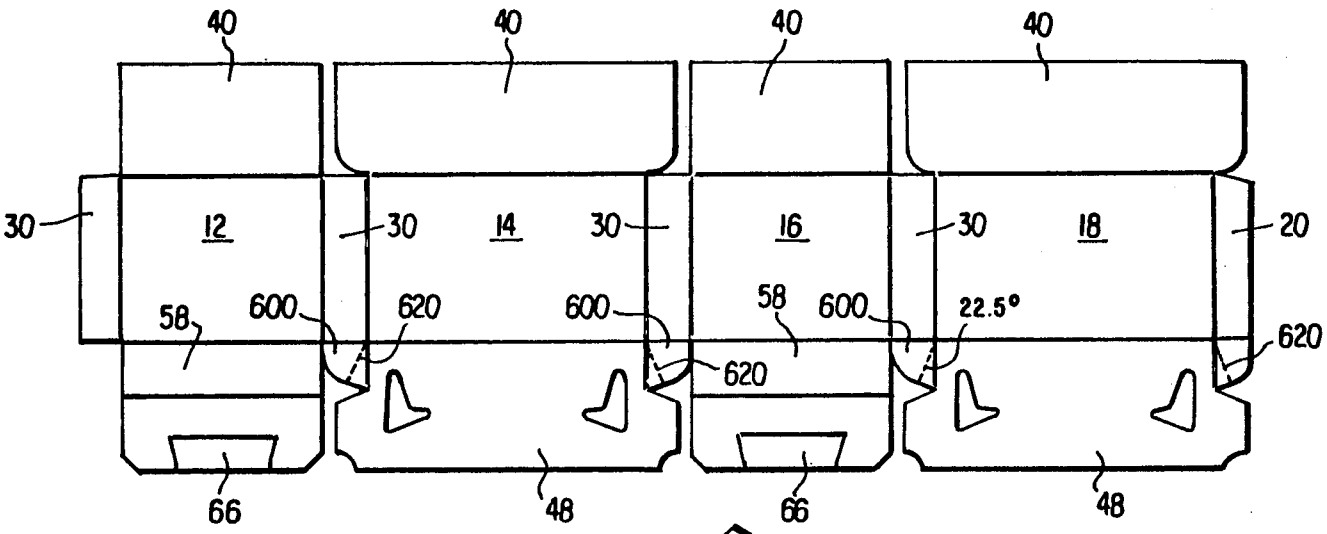
FIG. 6 is a plan view of a unitary blank, also of corrugated paperboard, from which a fourth embodiment of the container of this invention is formed.

Referring now to FIG. 6 of the drawings, a second unitary blank, denoted as 100, and also fashioned typically from corrugated paperboard is shown. The reader will observe the similarity of elements, and corresponding reference numerals are employed to designate corresponding elements in both FIGS. 1 and 6. While of slightly different shape, corresponding bottom panels 48 and 58 are functionally the same, and along with their associated openings, flaps and fold lines are also conventional and yield the same functional locking result as the above noted Austrian Pat. No. 218,420.

The essential difference between the blanks of FIGS. 1 and 6 relates to the gussets. Gussets 60 of the blank of FIG. 1 correspond to gussets 600 of the blank of FIG. 6, while fold lines 62 of the blank of FIG. 1 correspond to fold lines 620 of the blank of FIG. 6. The reader will observe that, firstly, the free edges of the gussets of the blank of FIG. 6 are convexly curved, instead of being straight as in the blank of FIG. 1 and, secondly, that the gussets 600 are each secured at corresponding second edges to the major longitudinal bottom panels 48, instead of (as in FIG. 1) foldably secured to the edges of the minor or width bottom panels. Again, a first side of each gusset 600 is foldably secured to the lower portion of corresponding corner forming panels 30.

Figure 7:
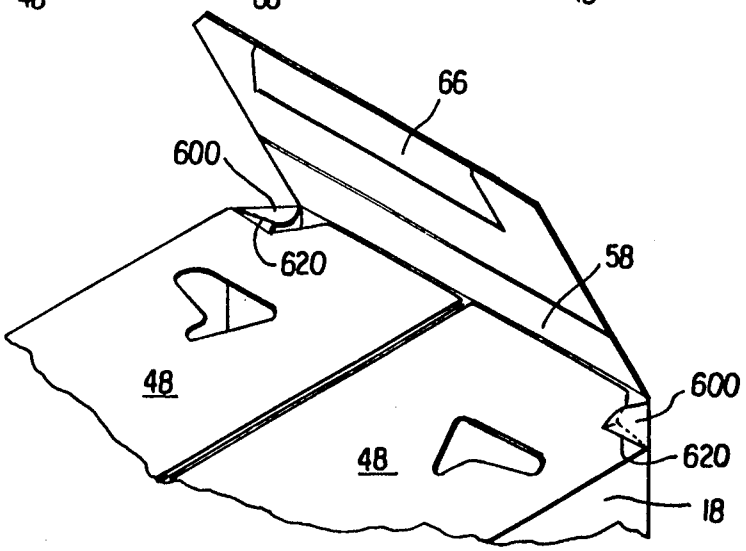
FIG. 7 is a view similar to FIG. 2 and illustrates the automatic folding of certain gussets upon folding of major panels.

Referring now to FIG. 7 of the drawings, the reader will observe that the intermediate step in erecting a container from its flattened tube position is similar to that shown at FIG. 2 with respect to the blank of FIG. 1. The same steps as above described are carried out for the erection or setting up of the bottom of the carton. An advantage of the construction of FIG. 6 is that upon folding the major bottom flaps 48 to the position shown at FIG. 7, the gussets will more positively and more reliably fold, not requiring manual pushing in along fold lines 620 to complete the gusset folding which has sometimes been required with the blank of FIG. 1.

Geometrical terms such as vertical and horizontal are employed to assist the reader to a full understanding of the invention and are not intended a limiting the invention.

I claim:

1. A unitary paperboard blank for forming a container, the blank being cut and scored to provide a plurality of panels including generally rectangular, alternating side and corner panels aligned end to end in series, each said side panel having an upper and a lower edge, bottom panels foldably joined along fold lines to the lower edge of respective said side panels, a plurality of gusset panels, each of said gusset panels having three sides, a first of said sides of each of said gusset panels foldably joined along a fold line to the lower edge of a respective said corner panel, a second of said sides of each of said gusset panels foldably joined along a fold line to an edge of a respective one of said bottom panels, a third of said sides of each of said gusset panels being free and not joined to any panel, a gusset fold line in each of said gusset panels, one end of each of said gusset fold lines located on said free edge and another end of each of said gusset fold lines located at a corner of its respective said gusset panel which corner is opposite said gusset free side, said bottom panels provided with means to interlock each bottom panel with two next adjacent of said bottom panels to form a closed, locked bottom for the container formed from said blank.

2. The blank of claim 1 wherein said plurality of panels are eight panels, four of said eight panels being said corner panels to which said first sides of each of said gusset panels are secured.

3. The blank of claim 2 including a plurality of top forming panels each foldably joined along a fold line to the upper edge of a respective said side panel, the upper edge of each of said corner panels being free and not connected to any panel.

4. The blank of claim 1 wherein each of said gusset panels is of right triangular shape, the hypotenuse of each gusset panel being said free side of each of said gusset panels.

5. The blank of claim wherein said fold line terminating at each said free gusset side is at an angle of about 22.5 degrees as measured from each said second gusset side.

6. The blank at claim 1 wherein said free side of each of said gusset panels is convexly curved.

7. The blank of claim 1 wherein said bottom panels are generally rectangular.

8. A paperboard container formed from a unitary paperboard blank, the container having sides which are defined by two length panels, two width panels, and four corner panels, each of said panels having an upper and a lower edge and being generally rectangular and forming the container with eight sides, major bottom panels foldably secured to the lower edges of respective of said length panels, minor bottom panels foldably secured to the lower edges of respective of said width panels for forming a bottom for the container, a plurality of gusset panels each having three sides, each of said gusset panels having the first of its three sides foldably secured along a fold line to the lower edge of each of said corner panels, the second of the three gusset panel sides foldably joined to a respective side edge of one of said bottom panels, the third of the three sides of each gusset panel being free and not connected to any panel, each of said gusset panels being folded about a fold line which has one end at said free, third gusset panel side and has another end of each of the gusset panel fold lines at a gusset panel corner opposite said free third side, whereby after the major bottom panels have been folded towards each other in erecting the container, folding of the two minor bottom panels towards each other produces a force on the gussets and spreads the length panels apart somewhat and the corner panels each assume a substantially 45 degree relation to respective next adjacent ones of said width and length panels to form an octagonal container.

9. The container of claim 8 wherein each of said bottom panels is interlocked with two next adjacent of said bottom panels, the two major bottom panels being substantially coplanar.

10. The container of claim 8 wherein each of said gusset panels is a right triangle.

11. The container of claim 8 wherein each said fold line terminating at said gusset free side is at an angle of about 22.5 degrees as measured from a respective said second gusset side.

12. The container of claim 8 including a top forming panel foldably secured to the upper edge of each of said length and width forming panels.

13. The container of claim 8 wherein one of said corner panels is of substantially double thickness of said paperboard.

14. The container of claim 8 wherein each said second gusset side is foldably joined to a respective side edge of a said minor bottom panel.

15. The container of claim 8 wherein each said second gusset side is foldably joined to a respective one of said side edges of a said major bottom panel.

16. The container of claim 8 wherein said free side of each gusset panel is straight.

17. The container of claim 8 wherein said free side of each gusset panel is convexly curved.

18. The container of claim 8 wherein said blank is formed of corrugated paperboard.

19. The blank of claim 1 wherein said blank is formed of corrugated paperboard.

* * * * *